United States Patent [19]

Herchenroeder et al.

[11] 4,450,007

[45] May 22, 1984

[54] PROCESS FOR ELECTROSLAG REMELTING OF MANGANESE-BASE ALLOYS

[75] Inventors: Robert B. Herchenroeder, Kokomo; Boyd A. Heath, Tipton, both of Ind.

[73] Assignee: Cabot Corporation, Kokomo, Ind.

[21] Appl. No.: 449,323

[22] Filed: Dec. 13, 1982

[51] Int. Cl.[3] ..... C22B 4/06

[52] U.S. Cl. ..... 75/10 C; 75/10 R; 75/12; 420/434

[58] Field of Search ..... 75/10 R, 10 C, 11, 12; 164/50, 52, 82, 250, 252; 420/434

[56] References Cited

U.S. PATENT DOCUMENTS

| | | | |
|---|---|---|---|
| 3,857,702 | 12/1974 | Corbett | 75/94 |
| 4,161,398 | 7/1979 | Tommaney | 75/10 R |
| 4,161,399 | 7/1979 | Tommaney | 75/10 R |

FOREIGN PATENT DOCUMENTS

| | | | |
|---|---|---|---|
| 979583 | 1/1965 | United Kingdom | 75/10 R |

OTHER PUBLICATIONS

Duckworth & Hoyle, "Electro-Slag Refining," p. 154 (1969).

*Primary Examiner*—Peter D. Rosenberg
*Attorney, Agent, or Firm*—J. Schuman; R. F. Dropkin

[57] ABSTRACT

An electroslag remelting process for manganese-base alloys. The process includes the steps of: partially immersing a consumable electrode of a manganese-base alloy in a layer of molten slag and passing current between the consumable electrode and a second electrode. The current is passed through the slag layer under conditions which gradually melt the consumable electrode so that drops of molten metal from the consumable electrode move downwardly through the slag layer and resolidify as an ingot thereunder. The slag is characterized by a fusion temperature of more than 300° F. (149° C.), and often more than 350° F. (177° C.), above the melting point of the consumable electrode. It is preferably comprised of $Al_2O_3$, CaO and $CaF_2$.

10 Claims, No Drawings

PROCESS FOR ELECTROSLAG REMELTING OF MANGANESE-BASE ALLOYS

The present invention relates to an electroslag remelting process for manganese-base alloys.

Electroslag remelting is a secondary melting or refining process. Primary production ingots, known as consumable electrodes, are remelted and allowed to resolidify under more exactly controlled conditions than can be achieved during primary melting, to improve their grain structure and to remove inclusion-forming impurities. Remelting is achieved by resistance heating, with the electric current passing between the consumable electrode and a second electrode. The consumable electrode is partially immersed in a layer of slag, in which Joule heat for melting is generated. A pool of molten metal forms below the slag. The slag provides a predictable direct path for the current and good control of melt rate and pool size. The slag removes inclusion-forming impurities from the melt.

The electroslag remelting of manganese-base alloys has been found to be more troublesome than is the electroslag remelting of other alloys such as nickel-base, cobalt-base and iron-base alloys. This is attributable to the reactive nature of manganese, to the high solidification shrinkage of manganese-base alloys and to the relatively low melting points of manganese-base alloys.

The present invention provides an improvement in the electroslag remelting of manganese-base alloys. Excellent ingot surface and an easily controlled melting cycle have been achieved with the use of a slag having a fusion temperature more than 300° F. (149° C.), and often more than 350° F. (177° C.), above the melting point of the alloy being remelted. Those skilled in the art have heretofore thought that a slag could not be maintained molten if it has a fusion point more than 300° F. (149° C.) higher than the melting point of the alloy. The slag of the present invention preferably contains $Al_2O_3$, CaO and $CaF_2$.

A slag containing $Al_2O_3$, CaO and $CaF_2$ is disclosed in U.S. Pat. No. 3,857,702. Such a slag has been used in the electroslag remelting of nickel-base, cobalt-base and iron-base alloys. Nickel-base, cobalt-base and iron-base alloys have substantially higher melting points than do manganese-base alloys.

U.S. Pat. No. 4,161,399 discloses a slag specifically for use with manganese-base alloys. The slag which is a mixture of barium fluoride and calcium fluoride, is fused at a temperature within the range of from about 200° F. (93° C.) below the melting point of the alloy to about 100° F. (38° C.) above the melting point of the alloy. Such a slag would not be characterized as one having a high fusion point in comparison to the melting point of the alloy. On the other hand, the slag of the present invention would be so characterized.

It is accordingly an object of the present invention to provide an electroslag remelting process for manganese-base alloys.

The present invention includes the steps of: partially immersing a consumable electrode of a manganese-base alloy in a layer of molten slag and passing current between the consumable electrode and a second electrode. The current is passed through the slag layer under conditions which gradually melt the consumable electrode so that drops of molten metal from the consumable electrode move downwardly through the slag layer and resolidify as an ingot thereunder. The slag is characterized by a fusion temperature of more than 300° F. (149° C.), and often more than 350° F. (177° C.), above the melting point of the consumable electrode. It is preferably comprised of $Al_2O_3$, CaO and $CaF_2$, and generally contains, by weight, at least 5% $Al_2O_3$, at least 5% CaO and at least 60% $CaF_2$. One particular slag consists essentially of 5 to 20% $Al_2O_3$, 5 to 20% CaO and 60 to 80% $CaF_2$.

Although the subject invention is believed to be suitable for use with any manganese-base alloy (alloys which usually have at least 50% manganese), it is believed to be particularly suitable for manganese-base alloys containing both copper and nickel. Such alloys usually contain at least 10% copper and at least 5% nickel. One particular alloy consists essentially of, by weight, from 69 to 77% manganese, from 11 to 24% copper and from 5 to 15% nickel, and preferably, from 71 to 73% manganese, from 17 to 19% copper and from 9 to 11% nickel.

No criticality is placed upon the choice of the second electrode. It can, for example, by the ingot being formed, the mold or a non-consumable electrode immersed in the slag. Either alternating or direct current may be used.

The following examples are illustrative of several aspects of the invention.

EXAMPLE I

A 75% manganese, 25% copper alloy was precast into an electrode having a diameter of approximately 2.7 inches (6.9 cm). The electrode weighed approximately 50 pounds (22.7 kg).

The electrode was prepared for electroslag remelting by cropping (saw cutting) about one inch from the hot top and butt ends. An adapter was welded to the butt end for attaching the electrode to the electroslag remelting equipment. The electrode was then suspended in the electroslag remelting unit with the hot top of the electrode down.

Five pounds of a slag containing, by weight, 15% $Al_2O_3$, 15% CaO and 70% $CaF_2$ was premelted in an induction furnace using a graphite susceptor. The molten slag was poured into the ingot mold of the electroslag remelting unit. The ingot mold was a water-cooled copper mold having a diameter of approximately 4 inches (10.2 cm).

The power was turned on immediately after the molten slag was poured into the ingot mold. The mold served as the second electrode. Power settings were 30 volts and approximately 2200 amperes. Power was shut off when the manganese-base alloy electrode was consumed.

The melting cycle was quiet and uneventful. It was, accordingly, easy to control.

The ingot was removed from the mold and examined, after an appropriate time sufficient to allow the system to cool. The side walls were found to be smooth. Top shrinkage was typical for an electroslag remelted product.

The ingot was subsequently forged and rolled with no difficulty.

EXAMPLE II

A 72% manganese, 18% copper, 10% nickel alloy was precast into an approximately 50 pound (22.7 kg) electrode having a diameter of approximately 2.7 inches (6.9 cm) and electroslag remelted according to the procedure of Example I. Power settings were 30 volts and approximately 2400 amperes.

The melting cycle was easy to control.

The side walls of the ingot were found to be smooth. Top shrinkage was typical for an electroslag remelted product.

EXAMPLE III

An alloy having a nominal composition of 17% copper, 9% nickel, 1% iron, 1% cobalt, 0.1% silicon, 0.5% chromium, 0.5% molybdenum, 0.2% aluminum, 0.05% carbon, balance essentially manganese was precast into an electrode having a diameter of 2.7 inches (6.9 cm) and electroslag remelted according to the procedure of Example I. The slag was premelted to a temperature of 3000° F.±25° F. (1649° C.±14° C.). Power settings were 30 volts and approximately 3000 amperes.

The melting cycle was easy to control.

The side walls of the ingot were found to be smooth. Top shrinkage was typical for an electroslag remelted product.

EXAMPLE IV

An alloy having a nominal composition of 65% manganese, 35% copper was precast into an electrode having a diameter of 2.7 inches (6.9 cm) and electroslag remelted according to the procedure of Example I. The slag was premelted to a temperature of 3050° F. (1677° C.) (immersion thermocouple measurement). Power settings were 30 volts for 7 minutes and 28.5 volts for 24 minutes, and approximately 2400 amperes.

The melting cycle was easy to control.

The side walls of the ingot were found to be smooth. Top shrinkage was typical for an electroslag remelted product.

EXAMPLE V

A 28.09% copper, balance manganese alloy was precast into an electrode having a diameter of 2.7 inches (6.9 cm) and electroslag remelted according to the procedure of Example I. The slag was premelted to a temperature of 3050° F. (1677° C.) (immersion thermocouple measurement). Power settings were 30 volts and approximately 2500 amperes for 10 minutes, 30 volts and approximately 2300 amperes for 6 minutes and 30 volts and approximately 2200 amperes for 6 minutes.

The melting cycle was easy to control.

The side walls of the ingot were found to be smooth. Top shrinkage was typical for an electroslag remelted product.

The foregoing examples demonstrate that a variety of manganese-base alloys can be remelted using a slag containing $Al_2O_3$, CaO and $CaF_2$ within a spectrum of instrument control settings, with good results and without adverse operational difficulties such as fluctuations in electrical operation (unstable voltage and amperage which result in periodic arcing and substandard ingot side walls). A slag containing from 5 to 20% $Al_2O_3$, from 5 to 20% CaO and from 60 to 80% $CaF_2$ has been shown to be compatible with alloys having from 69 to 77% manganese, from 11 to 24% copper and from 5 to 15% nickel, with respect to maintaining chemical composition of the alloy being remelted, with respect to the surface quality of the product produced and with respect to the electrical operation of the electroslag remelting unit.

It will be apparent to those skilled in the art that the novel principles of the invention disclosed herein in connection with specific examples thereof will suggest various other modifications and applications of the same. Those skilled in the art will, for example, readily recognize that operating conditions, especially electrical settings, will vary substantially with the characteristics of a particular electroslag remelting unit and with the size and shape of the electrode to be remelted. An electrode with a cross sectional area of about 200 square inches (1,290 square cm) might require a melting current of from 10,000 to 20,000 amperes or more, depending upon the internal ingot structure and melt rate desired. It is accordingly desired that in construing the breadth of the appended claims they shall not be limited to the specific examples of the invention described herein.

We claim:

1. In a process for refining a metal by partially immersing a consumable electrode of said metal in a layer of molten slag and passing current between said consumable electrode and a second electrode through said slag layer under conditions which gradually melt said consumable electrode so that drops of molten metal from said consumable electrode move downwardly through said slag layer and resolidify as an ingot thereunder, the improvement comprising the steps of immersing a consumable electrode of a manganese-base alloy in a slag characterized by a liquidus temperature of more than 300° F. (149° C.) above the melting point of said consumable electrode and passing current between said consumable electrode and said second electrode through said slag, said slag being comprised of $Al_2O_3$, CaO and $CaF_2$.

2. The process according to claim 1, wherein said slag is characterized by a liquids temperature of more than 350° F. (177°) above the melting point of said consumable electrode.

3. The process according to claim 1, wherein said manganese-base alloy contains both copper and nickel.

4. The process according to claim 1, wherein said slag contains, by weight, at least 5% $Al_2O_3$, at least 5% CaO and at least 60% $CaF_2$.

5. The process according to claim 3, wherein said manganese-base alloy contains, by weight, at least 10% copper and at least 5% nickel.

6. The process according to claim 4, wherein said slag consists essentially of 5 to 20% $Al_2O_3$, 5 to 20% CaO and 60 to 80% $CaF_2$.

7. The process according to claim 5, wherein said manganese-base alloy consists essentially of 69 to 77% manganese, 11 to 24% copper and 5 to 15% nickel.

8. The process according to claim 7, wherein said manganese-base alloy consists essentially of 71 to 73% manganese, 17 to 19% copper and 9 to 11% nickel.

9. A manganese-base alloy consisting essentially of, by weight, 69 to 77% manganese, 11 to 24% copper and 5 to 15% nickel and made in accordance with the process of claim 1.

10. An ingot of an alloy consisting essentially of, by weight, 69 to 77% manganese, 11 to 24% copper and 5 to 15% nickel, electroslag remelted in a slag consisting essentially of, by weight, 5 to 20% $Al_2O_3$, 5 to 20% CaO and 60 to 80% $CaF_2$.

* * * * *